US010865026B2

(12) United States Patent
Wessely

(10) Patent No.: US 10,865,026 B2
(45) Date of Patent: Dec. 15, 2020

(54) BLISTER PACKAGING, COVER FILM AND PRODUCTION METHOD

(71) Applicant: GIESECKE+DEVRIENT CURRENCY TECHNOLOGY GMBH, Munich (DE)

(72) Inventor: Stephan Wessely, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 299 days.

(21) Appl. No.: 16/077,160

(22) PCT Filed: Feb. 16, 2017

(86) PCT No.: PCT/EP2017/000222
§ 371 (c)(1),
(2) Date: Aug. 10, 2018

(87) PCT Pub. No.: WO2017/140427
PCT Pub. Date: Aug. 24, 2017

(65) Prior Publication Data

US 2019/0062020 A1 Feb. 28, 2019

(30) Foreign Application Priority Data

Feb. 17, 2016 (DE) ..... 10 2016 001 829

(51) Int. Cl.
*B65D 75/36* (2006.01)
*A61J 1/03* (2006.01)
(Continued)

(52) U.S. Cl.
CPC ..... *B65D 75/367* (2013.01); *A61J 1/035* (2013.01); *B65B 11/52* (2013.01); *B65D 65/40* (2013.01); *B65D 75/327* (2013.01)

(58) Field of Classification Search
CPC ..... B42D 25/00–391; A61J 1/035; B65D 75/32–368; G02B 5/286; B65B 11/52; C09D 5/29
See application file for complete search history.

(56) References Cited

U.S. PATENT DOCUMENTS 6,244,442 B1 6/2001 Inoue et al.
9,274,258 B2 3/2016 Fuhse et al.
(Continued)

FOREIGN PATENT DOCUMENTS

DE 102009041583 A1 3/2011
DE 102009058243 A1 6/2011
(Continued)

OTHER PUBLICATIONS

International Search Report from PCT Application No. PCT/EP2017/000222, dated Mar. 30, 2017.

*Primary Examiner* — Kregg T Brooks
(74) *Attorney, Agent, or Firm* — Workman Nydegger

(57) ABSTRACT

A blister package comprises a plastic foil molding furnished with cavities and an opaque cover foil having at least one transparent region arranged outside of the cavities. The plastic foil molding defines the front side of the blister package and the opaque cover foil defines the back side of the blister package, and the blister package additionally has in a certain region, which is formed outside of the region of the cavities of the plastic foil molding and is arranged overlapping at least the transparent region of the opaque cover foil, a semi-transparent function layer. The semi-transparent function layer is constituted such that the blister package has in the transparent region of the opaque cover foil upon viewing in incident light a first, visually recognizable color and upon viewing in transmitted light has a second, visually recognizable color.

12 Claims, 6 Drawing Sheets

(51) Int. Cl.

| | |
|---|---|
| ***B65D 75/32*** | (2006.01) |
| ***B65B 11/52*** | (2006.01) |
| ***B65D 65/40*** | (2006.01) |

(56) References Cited

U.S. PATENT DOCUMENTS

| | | | | |
|---|---|---|---|---|
| 10,029,506 | B2 | 7/2018 | Fuhse | |
| 2001/0032796 | A1 | 10/2001 | Rubenstein | |
| 2003/0102247 | A1 | 6/2003 | Inoue et al. | |
| 2012/0031978 | A1* | 2/2012 | Hansen | B42D 25/00 235/488 |
| 2012/0170124 | A1 | 7/2012 | Fuhse et al. | |
| 2012/0242075 | A1 | 9/2012 | Lochbihler | |
| 2012/0301639 | A1* | 11/2012 | Grigorenko | C09D 7/68 428/29 |
| 2015/0258838 | A1 | 9/2015 | Fuhse | |
| 2015/0352886 | A1* | 12/2015 | Holmes | B42D 25/29 359/2 |

FOREIGN PATENT DOCUMENTS

| | | | |
|---|---|---|---|
| DE | 102014011663 | A1 | 2/2016 |
| EP | 1876033 | A1 | 1/2008 |
| WO | 9710159 | A1 | 3/1997 |
| WO | 2005051675 | A2 | 6/2005 |
| WO | 2006056216 | A1 | 6/2006 |
| WO | 2011032665 | A1 | 3/2011 |
| WO | 2011064162 | A2 | 6/2011 |
| WO | 2011082761 | A1 | 7/2011 |
| WO | 2014060089 | A2 | 4/2014 |

* cited by examiner

BLISTER PACKAGING, COVER FILM AND PRODUCTION METHOD

BACKGROUND

The invention relates to a blister package, comprising a plastic foil molding, a cover foil and a semi-transparent function layer which is constituted such that upon viewing in incident light it has a first, visually recognizable color and upon viewing in transmitted light it has a second, visually recognizable color. The invention furthermore relates to a cover foil suitable for manufacturing the hereinabove mentioned blister package and a method for manufacturing the hereinabove mentioned blister package.

A blister package (or blister, display package) is understood to mean a product package which enables the potential buyer to perceive the packaged object optically or to surmise at least the form of the object. Here, the object is fixed by a plastic foil molding enclosed by a cover foil. For drugs, e.g. tablets, the cover foil usually consists of aluminum. A tablet package or a tablet blister is also called push-through pack. The arrangement of the tablets in individual depressions or cavities of the plastic foil molding, which is sealed by the aluminum foil, is hygienically advantageous because unwanted influences like high air moisture or dirt are excluded.

The manufacture of blisters is described e.g. in WO 97/010159 A1.

EP 1 876 033 A1 describes a packaging material, in particular for the pharmaceutical field, which has a metallic carrier substrate with a line grid printed in two different visually recognizable colors.

The present invention is based on the task of increasing the anti-forgery security of the blister packages of the prior art.

The task is achieved by the feature combinations defined in the independent claims. Developments of the invention are the subject matter of the subclaims.

SUMMARY OF THE INVENTION

Summary

1. (First Aspect of the Invention)

A blister package, comprising a plastic foil molding furnished with cavities and an opaque cover foil having at least one transparent region arranged outside of the cavities, wherein the plastic foil molding defines the front side of the blister package and the opaque cover foil the back side of the blister package, and the blister package additionally has in a certain region, which is formed outside of the region of the cavities of the plastic foil molding and is arranged overlapping at least the transparent region of the opaque cover foil, a semi-transparent function layer, which is constituted such that the blister package has in the transparent region of the opaque cover foil upon viewing in incident light a first, visually recognizable color and upon viewing in transmitted light has a second, visually recognizable color.

The transparent region of the opaque cover foil can be present in particular in the form of a pattern, in the form of sign or in the form of an encoding.

The plastic foil molding has several depressions or cavities, wherein the depressions or cavities are suitable for receiving objects to be packaged, e.g. tablets.

In the blister package, the color change upon viewing in transmitted light, on the one hand, and upon viewing in incident light, on the other hand, can be perceived especially well if the plastic foil molding is transparent.

The semi-transparent function layer is obtainable e.g. by means of vapor deposition or printing technology. The semi-transparent function layer can have a single-layer or a multilayer construction. In case of a multilayer construction, it is possible that all layers are generated by means of vapor deposition; alternatively it is possible that one or several layers are generated by means of vapor deposition and a further or several further layers are generated by printing technology (for example, two semi-transparent metallic layers generated by means of vapor deposition and arranged therebetween a nitrocellulose-based dielectric layer obtainable by printing technology). Furthermore, the semi-transparent function layer can be present e.g. in the form of a continuous coating or can be present in the form of a discontinuous coating generated e.g. from metallic pigments or effect pigments. Concrete examples in regard to the semi-transparent function layer are in particular the following layer systems A), B) C) and D):

A) two semi-transparent metallic layers and an intermediate dielectric layer arranged therebetween;

B) two semi-transparent metallic layers and arranged therebetween an intermediate color layer (e.g. in blue color) preferably 1 to 2 micrometers thick; preferably the two semi-transparent metallic layers are additionally coated on the outer side respectively with a further color layer, preferably 1 to 2 micrometer thick, in particular in a complementary color to the color layer (e.g. in yellow color) arranged between the metallic layers (in this manner the following layer buildup with a gold/blue color change results in incident light or transmitted light viewing: yellow printed layer-semi-transparent metallic layer-blue printed layer-semi-transparent metallic layer-yellow printed layer); furthermore, e.g. the following layer system is possible, comprising the layers a) to c): a) "silver" mirror layer dyed yellow, obtainable by means of metal pigments dyed yellow, which are known from WO 2005/051675 A2 (the metal pigments are based on a metal which is chosen preferably from the group consisting of aluminum, stainless steel, nichrome, gold, silver, platinum and copper; the metal is in particular preferably aluminum, wherein the average particle diameter preferably lies in a range from 8 to 15 μm, further preferably in a range from 9 to 10 μm, as measured with Coulter LS130 laser diffraction granulometer; such a printing ink enables the supplying of a "silver" mirror layer, b) a blue color layer preferably 1 to 2 micrometer thick, c) a "silver" mirror layer dyed yellow, obtainable by means of metal pigments dyed yellow which are known from WO 2005/051675 A2 (see for this purpose the description as to layer a));

C) the upper layer system can be configured alternatively such that some of the layers are arranged on the front side of a carrier substrate and some layers are arranged on the back side of the carrier substrate; e.g. the following layer system is possible, comprising the layers a) to f): a) a yellow color layer preferably 1 to 2 micrometer thick, b) a semi-transparent metallic layer (e.g. aluminum), c) a carrier substrate (e.g. COC or PET foil), d) a blue color layer preferably 1 to 2 micrometer thick, e) a semi-transparent metallic layer (e.g. aluminum), f) a yellow color layer preferably 1 to 2 micrometer thick; furthermore, e.g. the following layer system is possible, comprising the layers a) to d): a) "silver" mirror layer dyed yellow, obtainable by means of metal pigments dyed yellow, which are known from WO 2005/051675 A2 (the metal pigments are based on a metal which is chosen preferably from the group consisting of aluminum, stainless steel, nichrome, gold, silver, platinum and copper; the metal is in particular preferably aluminum, wherein the average particle diameter preferably lies in a range from 8 to 15 μm, further preferably in a range from 9 to 10 μm, as measured with Coulter LS130 laser diffraction granulometer; such a printing ink enables the supplying of a "silver" mirror layer, b) a carrier substrate (e.g. COC or PET foil), c) a blue color layer preferably 1 to 2 micrometer thick, d) a "silver" mirror layer dyed yellow, obtainable by means of metal pigments dyed yellow which are known from WO 2005/051675 A2 (see for this purpose the description as to layer a)); D) the layer systems stated above under B) and C) can of course be varied with regard to the yellow color layer and the blue color layer to the effect that instead of blue or yellow other colors are employed which are in particular mutually complementary.

The plastic foil molding is e.g. based on one of the following materials which can be present respectively as an individual layer or in the form of several layers:

PVC (polyvinyl chloride),
PVDC (polyvinylidene chloride),
PVC/PVDC multilayer arrangement,
PVC/PE/PVDC multilayer arrangement,
PVC/ACLAR® multilayer arrangement,
PP (polypropylene),
PET (polyester),
PS (polystyrene),
COP (cyclic olefin polymer),
COC (cyclic olefin copolymer),
COC/COC multilayer arrangement,
PP/COC/PP multilayer arrangement,
PP/COC/EVOH/PP multilayer arrangement,
PETG/COC/PETG multilayer arrangement,
PVC/COC/PVC multilayer arrangement,
PVDC-coated COC,
PETG/PCTFE multilayer arrangement,
PETG/EVOH/PCTFE multilayer arrangement,
PVC/PCTFE multilayer arrangement,
PVC/PE/PCTFE multilayer arrangement,
PVC/PCTFE/PVC multilayer arrangement, and
PVC/EVOH/PCTFE multilayer arrangement.

The opaque cover foil is in particular a push-through foil. The foil in particular can be a metallic foil and is preferably chosen from the following materials: aluminum, in particular hard aluminum, soft aluminum, a paper-aluminum combination or paper-polyester-aluminum laminate.

For the sealing of the plastic foil molding with the cover foil, the cover foil can have in particular a heat-seal lacquer (or heat-seal binder) which is arranged on the cover foil, where applicable, by means of a heat-seal lacquer primer (or adhesion promoter). Instead of the phrase "heat-seal binder and optionally present adhesion promoter", the term "heat-seal coating" is also employed herein.

2. (Preferred Embodiment)

The blister package according to item 1, wherein the semi-transparent function layer is formed on a carrier substrate and the carrier substrate furnished with the semi-transparent function layer is arranged between the plastic foil molding and the opaque cover foil.

The carrier substrate is in particular a plastic foil, e.g. a polyethylene terephthalate (PET) foil or a Cycloolefin copolymer (COC) foil.

The carrier substrate furnished with the semi-transparent function layer can be arranged in particular by means of an adhesive layer on the opaque cover foil.

3. (Preferred Embodiment)

The blister package according to item 1, wherein the semi-transparent function layer is formed on a carrier substrate and the carrier substrate furnished with the semi-transparent function layer is arranged above the side opposing the plastic foil molding of the opaque cover foil.

The carrier substrate is in particular a plastic foil, e.g. a polyethylene terephthalate (PET) foil or a Cycloolefin copolymer (COC) foil.

The carrier substrate furnished with the semi-transparent function layer can be arranged in particular by means of an adhesive layer on the opaque cover foil.

4. (Preferred Embodiment)

The blister package according to item 1, wherein the semi-transparent function layer is formed either directly on the plastic foil molding or within the plastic foil molding.

For example, the semi-transparent function layer can be generated by printing technology directly on the plastic foil molding.

It is furthermore possible that the plastic foil molding is based on a multilayer arrangement having at least two layers and the semi-transparent function layer is arranged between the two layers, or the plastic foil molding is based on a multilayer arrangement with at least one inner layer and two cover layers and the semi-transparent function layer is arranged between the inner layer and one of the two cover layers, wherein the multilayer arrangement is preferably chosen from the group of the following elements:

PVC/PVDC multilayer arrangement,
PVC/PE/PVDC multilayer arrangement,
PVC/ACLAR® multilayer arrangement,
COC/COC multilayer arrangement,
PP/COC/PP multilayer arrangement,
PP/COC/EVOH/PP multilayer arrangement,
PETG/COC/PETG multilayer arrangement,
PVC/COC/PVC multilayer arrangement,
PVDC-coated COC,
PETG/PCTFE multilayer arrangement,
PETG/EVOH/PCTFE multilayer arrangement,
PVC/PCTFE multilayer arrangement,
PVC/PE/PCTFE multilayer arrangement,
PVC/PCTFE/PVC multilayer arrangement, and
PVC/EVOH/PCTFE multilayer arrangement.

5. (Preferred Embodiment)

The blister package according to any of items 1 to 4, wherein the semi-transparent function layer has a multilayer construction having two semi-transparent metallic layers and a dielectric layer arranged between the two semi-transparent metallic layers.

6. (Preferred Embodiment)

The blister package according to item 5, wherein the two semi-transparent metallic layers are formed independently of each other from a metal and the metal respectively is chosen from the group consisting of Al, Ag Ni, Cr, Cu, Au and an alloy of one or several of the hereinabove mentioned elements and the dielectric layer is a $SiO_2$ layer, a ZnO layer, an $Al_2O_3$ layer, a $TiO_2$ layer, a layer of a nitride or oxynitride of the elements Si, Zn, Al or Ti or a $MgF_2$ layer or a nitrocellulose layer, obtainable e.g. by printing technology.

7. (Preferred Embodiment)

The blister package according to item 6, wherein the two semi-transparent metallic layers are chosen from Al or Ag and the dielectric layer is a $SiO_2$ layer.

8. (Preferred Embodiment)

The blister package according to any of items 5 to 7, wherein the blister package in the transparent region of the opaque cover foil upon viewing in incident light appears gold-colored and upon viewing in transmitted light has a blue color tone.

9. (Preferred Embodiment)

The blister package according to any of items 1 to 4, wherein the semi-transparent function layer is obtainable by printing technology by means of an effect pigment composition.

10. (Preferred Embodiment)

The blister package according to any of items 1 to 9, wherein the opaque cover foil is a metallic foil, in particular an aluminum foil, and the transparent region of the opaque cover foil is formed in the form of a recess in the opaque cover foil.

The recess can be generated in particular by means of punching or by means of laser cutting.

11. (Preferred Embodiment)

The blister package according to any of items 1 to 10, wherein the blister package is a blister for pharmaceutical products, in particular a tablet blister.

12. (Second Aspect of the Invention)

A cover foil, suitable for the covering of a plastic foil molding of a blister package, wherein the cover foil is opaque and has at least one transparent region, and has in a certain region, which is adapted such that it is formed outside of the region of the cavities of the plastic foil molding and is arranged overlapping at least the transparent region of the opaque cover foil, a semi-transparent function layer which is constituted such that the cover foil in the transparent region upon viewing in incident light has a first, visually recognizable color and upon viewing in transmitted light has a second, visually recognizable color.

For the sealing of a plastic foil molding with the cover foil, the cover foil can have in particular a heat-seal lacquer (or heat-seal binder) which is arranged on the cover foil, where applicable, by means of a heat-seal lacquer primer (or adhesion promoter). Instead of the phrase "heat-seal binder and optionally present adhesion promoter", the term "heat-seal coating" is also employed herein.

The opaque cover foil is in particular a push-through foil. The foil in particular can be a metallic foil and be further specifically chosen from the following materials: Aluminum, in particular hard aluminum, soft aluminum, a paper-aluminum combination or paper-polyester-aluminum laminate.

13. (Preferred Embodiment)

The cover foil according to item 12, wherein the semi-transparent function layer is formed on a carrier substrate, e.g. a plastic foil, and the carrier substrate furnished with the semi-transparent function layer is arranged above the opaque cover foil.

14. (Preferred Embodiment)

The cover foil according to any of items 12 to 13, wherein the semi-transparent function layer has a multilayer construction having two semi-transparent metallic layers and a dielectric layer arranged between the two semi-transparent metallic layers.

15. (Preferred embodiment)

The cover foil according to item 14, wherein the two semi-transparent metallic layers are formed independently of each other from a metal and the metal respectively is chosen from the group consisting of Al, Ag Ni, Cr, Cu, Au and an alloy of one or several of the hereinabove mentioned elements and the dielectric layer is a $SiO_2$ layer, a ZnO layer, an $Al_2O_3$ layer, a $TiO_2$ layer, a layer of a nitride or oxynitride of the elements Si, Zn, Al or Ti or a $MgF_2$ layer or a nitrocellulose layer, obtainable e.g. by printing technology.

16. (Preferred Embodiment)

The cover foil according to item 15, wherein the two semi-transparent metallic layers are chosen from Al or Ag and the dielectric layer is a $SiO_2$ layer.

17. (Preferred Embodiment)

The cover foil according to any of items 14 to 16, wherein the cover foil in the transparent region upon viewing in incident light appears gold-colored and upon viewing in transmitted light has a blue color tone.

18. (Preferred Embodiment)

The cover foil according to any of items 12 to 13, wherein the semi-transparent function layer is obtainable by printing technology by means of an effect pigment composition.

19. (Preferred Embodiment)

The cover foil according to any of items 13 to 18, wherein the carrier substrate arranged above the opaque cover foil, having the semi-transparent function layer, is of the shape of a multiplicity of strips or patches.

20. (Preferred Embodiment)

The cover foil according to any of items 12 to 19, wherein the cover foil is a metallic foil, in particular an aluminum foil, and the transparent region of the opaque cover foil is formed in the form of a recess in the opaque cover foil.

21. (Preferred Embodiment)

The cover foil according to any of items 12 to 20, suitable for manufacturing a blister package according to any of items 1 to 3 or according to any of items 5 to 11 dependent on items 1 to 3.

22. (Third Aspect of the Invention)

A method for manufacturing a blister package, comprising the step of covering a plastic foil molding furnished with cavities with a cover foil according to any of items 12 to 21.

DETAILED DESCRIPTION OF THE INVENTION

In the description, the terms "plastic foil molding" and "plastic form foil" are employed as synonyms.

The front side of the inventive blister package is defined by the plastic foil molding. The back side of the inventive blister package is defined by the cover foil.

A viewing in incident light as intended by this invention is an illumination of the respective object from one side and a viewing of the object from the same side. A viewing in incident light is thus present, for example, when the front of the blister is illuminated and also viewed.

A viewing in transmitted light as intended by this invention is an illumination of the respective object from one side and a viewing of the object from the opposite side. A viewing in transmitted light is therefore present, for example, when the back side of the blister is illuminated and the front side of the blister is viewed. The light therefore shines at least partly through the package.

The inventive blister package is characterized by the fact that it has a semi-transparent region with a color change upon viewing in incident light (reflection), on the one hand, and upon viewing in transmitted light (transmission), on the other hand. The color change is verifiable without technical aid with the naked eye and serves the authenticity control of the blister package. The authenticity check can be performed, e.g. before consuming the (pharmaceutical) products contained in the blister, e.g. tablets, for the first time.

The inventive blister package is especially advantageous as a result of its increased anti-forgery security, because semi-transparent blister packages with color change upon viewing in incident light, on the one hand, and upon viewing in transmitted light, on the other hand, are relatively difficult to access for the forger. Moreover, an uncomplicated authenticity check of the inventive blister package can be carried out by the consumer, also in case of a child, by viewing the blister package with regard to the plastic foil molding and/or with regard to the cover foil in incident light and in transmitted light without additional technical aids.

For elevating the protection from forgery, the cover foil or the plastic foil molding can be equipped with additional anti-forgery means, e.g.

- the supplying of an additional opaque coating, in particular a printed layer or a metallization which has recesses in the form of patterns, signs or an encoding;
- the printing with (micro) print, in particular with effect pigments;
- the supplying of the luminescing or magnetic security features which are capturable in particular by machine;
- the supplying of an additional hologram, in particular an emboss-lacquer layer with a diffractive relief structure which bears, where applicable, a metallization;
- the supplying of a micro-optic relief structure, in particular of a micromirror arrangement; the manufacture of a micro-optic relief structure is known in the prior art (see e.g. WO 2014/060089 A2).

The plastic foil molding is in particular transparent and is based e.g. on one of the following materials which can be present respectively as an individual layer or in the form of several layers:

PVC (polyvinyl chloride),
PVDC (polyvinylidene chloride),
PVC/PVDC multilayer arrangement,
PVC/PE/PVDC multilayer arrangement,
PVC/ACLAR® multilayer arrangement,
PP (polypropylene),
PET (polyester),
PS (polystyrene),
COP (cyclic olefin polymer),
COC (cyclic olefin copolymer),
COC/COC multilayer arrangement,
PP/COC/PP multilayer arrangement,
PP/COC/EVOH/PP multilayer arrangement,
PETG/COC/PETG multilayer arrangement,
PVC/COC/PVC multilayer arrangement,
PVDC-coated COC,
PETG/PCTFE multilayer arrangement,
PETG/EVOH/PCTFE multilayer arrangement,
PVC/PCTFE multilayer arrangement,
PVC/PE/PCTFE multilayer arrangement,
PVC/PCTFE/PVC multilayer arrangement, and
PVC/EVOH/PCTFE multilayer arrangement.

If the transparent carrier substrate of the plastic foil molding is based on a multilayer arrangement, two individual layers can be interconnected in particular by means of an adhesive layer (e.g., PVDC/adhesive layer/PVC construction, PVDC/adhesive layer/PE/adhesive layer/PVC construction or PP/adhesive layer/COC/adhesive layer/PP construction). Instead of an adhesive layer, a polymeric heat-seal layer, which is obtainable e.g. by means of coextrusion, can be employed for the improved connecting of two individual layers of a multilayer arrangement. As a polymeric heat-seal layer, e.g. polyethylene copolymer is suitable.

The plastic foil molding can have e.g. a material thickness in the range from 100 micrometers to 600 micrometers, wherein the range from 200 micrometers to 500 micrometers is preferred.

The semi-transparent function layer has different color tones upon viewing in incident light, on the one hand, and upon viewing in transmitted light, on the other hand. The two different color tones are e.g. complementary colors. Such a semi-transparent function layer is based e.g. on a multilayer construction with two semi-transparent metallic layers and a dielectric layer arranged between the two semi-transparent metallic layers. Such a multilayer construction, which upon viewing in incident light appears gold-colored and upon the viewing in transmitted light shows a blue color tone, is known e.g. from WO 2011/082761 A1. Moreover, WO 2011/032665 A1 describes similar multilayer structures.

Suitable multilayer structures with two semi-transparent metallic layers and a dielectric layer arranged between the two semi-transparent metallic layers preferably have the following material constitution:

the two semi-transparent metallic layers are preferably chosen from Al or Ag; the dielectric layer is a $SiO_2$ layer or a $MgF_2$ layer, preferably a $SiO_2$ layer;

in case that each of the two semi-transparent metallic layers is based on Al, the respective preferred layer thickness lies in a range of 5 nm to 20 nm, in particular preferably in a range of 10 nm to 14 nm; the dielectric $SiO_2$ layer has preferably a layer thickness in a range from 50 nm to 450 nm, further preferably in a range from 80 nm to 260 nm and in particular preferably in a range from 210 nm to 260 nm, wherein the regions from 80 nm to 100 nm and from 210 nm to 240 nm are particularly preferred specifically for the supplying of a gold/blue color change;

in case that each of the two semi-transparent metallic layers is based on Al, the respective preferred layer thickness lies in a range from 15 nm to 30 nm, in particular preferably from 15 nm to 25 nm; the dielectric $SiO_2$ layer has preferably a layer thickness in a range from 50 nm to 450 nm, further preferably in a range from 80 nm to 260 nm and in particular preferably in a range from 210 nm to 260 nm, wherein the ranges from 80 nm to 100 nm and from 210 nm to 240 nm are particularly preferred specifically for the supplying of a gold/blue color change.

The above-mentioned multilayer structures with two semi-transparent metallic layers and a dielectric layer arranged between the two semi-transparent metallic layers can have a symmetric three-layer buildup in which the material as well as the layer thickness of the two semi-transparent metallic layers are identical. Alternatively, however, an asymmetric three-layer buildup can also be present for which the material and/or the layer thickness of the two semi-transparent metallic layers are different, e.g.

- a silver/dielectrics/aluminum layer system, wherein the layer thicknesses of the silver layer and the aluminum layer are identical or different;
- a silver/dielectrics/aluminum layer system, wherein the layer thicknesses of the two silver layers are different;
- an aluminum/dielectrics/aluminum layer system, wherein the layer thicknesses of the two aluminum layers are different.

The above-mentioned multilayer layer constructions make not only the generation of a semi-transparent function layer possible, which upon viewing in incident light appears gold-colored and upon viewing in transmitted light shows a blue color tone, however, further color changes can be created depending on the choice of the layer thickness, in particular of the dielectric layer, e.g.

in incident light magenta, in transmitted light bluish-green;

in incident light turquoise, in transmitted light orange-yellow;

in incident light gold, in transmitted light blue-violet;

in incident light silver, in transmitted light violet.

A pharmaceutical manufacturer can utilize the different, above-mentioned color changes for the supplying its medicines in the form of different tablet packages according to a defined color encoding, wherein e.g. the following color encoding is conceivable:

Headache tablets: tablet package with a semi-transparent region which appears gold-colored in incident light and blue in transmitted light;

Tablets for stomach ache: Tablet package with a semi-transparent region which in incident light appears turquoise and in transmitted light orange-yellow.

Sleeping tablets: Tablet package with a semi-transparent region which in incident light appears magenta and in transmitted light blue-green.

The above color coding allows the consumer to avoid the inadvertent taking of tablets for stomach pain instead of headache tablets, e.g. in the event of a consciousness disorder.

A semi-transparent function layer, which has different color tones upon viewing in incident light, on the one hand, and upon viewing in transmitted light, on the other hand, can furthermore be based on an effect-pigment composition. Printed layers on the basis of an effect pigment composition, which upon viewing in incident light shows a different color than upon viewing in transmitted light, in particular a gold/blue color change, a gold/violet color change, a green-gold/magenta color change, violet/green color change or a silver/opaque color changes, are described e.g. in WO 2011/064162 A2. The pigments preferably have the longest dimension from end to end ("longest dimension of edge length") in a range from 15 nm to 1000 nm and are based on a transition metal which is chosen from the group consisting of Cu, Ag, Au, Zn, Cd, Ti, Cr, Mn, Fe, Co, Ni, Ru, Rh, Pd, Os, Ir and Pt. The transition metal is preferably Ag. The aspect ratio (i.e. the ratio of the longest end-to-end dimension of relating to the thickness) is preferentially at least 1.5, in particular in a range from 1.5 to 300. The ratio of the binding agent to metal pigment is preferably below 10:1, in particular below 5:1. In dependence on the choice of the aspect ratio of the pigment, its longest dimension from end to end and the setting of the pigment/binder ratio, the color can be adjusted upon viewing the printed layer in transmission and the color upon viewing in reflection (e.g. blue in transmission and silver, gold, bronze, copper or violet in reflection; moreover also violet, magenta, pink, green or brown in transmission and different colors in reflection which depend on the choice of the pigment/binder ratio). Colors with gold/blue color change between reflection and transmission (in other words, between incident-light viewing and transmitted-light viewing) are stated e.g. in the examples 1, 2 and 3 of table 1 of WO 2011/064162 A2. Furthermore, example 4 shows a color with gold/violet color change, example 5 a color with green-gold/magenta color change, example 7 a color with violet/green color change and example 8 a color with silver/opaque color change.

A pharmaceutical manufacturer can utilize the different, above-mentioned color changes for the supplying its medicines in the form of different tablet packages according to a defined color encoding, wherein e.g. the following color encoding is conceivable:

Headache tablets: tablet package with a semi-transparent region which appears gold-colored in incident light and blue in transmitted light;

Tablets for stomach ache: Tablet package with a semi-transparent region which appears green-gold in incident light and magenta in transmitted light.

Sleeping tablets: tablet package with a semi-transparent region which appears violet in incident light and green in transmitted light.

The above color coding allows the consumer to avoid the inadvertent taking of tablets for stomach pain instead of headache tablets, e.g. in the event of a consciousness disorder.

A semi-transparent function layer, which has different color tones upon viewing in incident light, on the one hand, and upon viewing in transmitted light, on the other hand, can furthermore be based at least partially on the use of conventional ink layers or color lacquers and be constituted according to one of the following variants:

1) two semi-transparent metallic layers (e.g. 5 nm to 15 nm of Al) and a color layer (e.g. in blue color) arranged therebetween, preferably 1 to 2 micrometers thick; preferably the two semi-transparent metallic layers are additionally coated on the outer side respectively with a further color layer, preferably 1 to 2 micrometer thick, in particular in a complementary color to the color layer (e.g. in yellow color) arranged between the metallic layers (in this manner the following layer buildup with a gold/blue color change results in incident light or transmitted light viewing: yellow printed layer-semi-transparent metallic layer-blue printed layer-semi-transparent metallic layer-yellow printed layer); furthermore, e.g. the following layer system is possible, comprising the layers a) to c): "silver" mirror layer dyed yellow, obtainable by means of metal pigments dyed yellow, which are known from WO 2005/051675 A2 (the metal pigments are based on a metal which is chosen preferably from the group consisting of aluminum, stainless steel, nichrome, gold, silver, platinum and copper; the metal is in particular preferably aluminum, wherein the average particle diameter lies preferably in the range from 8 to 15 μm, further preferably in the range from 9 to 10 μm, as measured with Coulter LS130 laser diffraction granulometer; such a printing ink enables the supplying of a "silver" mirror layer), a blue color layer preferably 1 to 2 micrometer thick, c) a "silver" mirror layer dyed yellow, obtainable by means of metal pigments dyed yellow, which are known from WO 2005/051675 A2 (see for this purpose the description as to layer a));

2) the upper layer system can be configured alternatively such that some of the layers are arranged on the front side of a carrier substrate (e.g. a COC or a PET foil) and some layers are arranged on the back side of the carrier substrate; e.g. the following layer system is possible, comprising the layers a) to f): a) a yellow color layer preferably 1 to 2 micrometer thick, b) a semi-transparent metallic layer (e.g., aluminum), c) a carrier substrate, d) a blue color layer preferably 1 to 2 micrometer thick, e) a semi-transparent metallic layer (e.g., aluminum), f) a yellow color layer preferably 1 to 2 micrometer thick; furthermore, e.g. the following layer system is possible, comprising the layers a) to d): a) "silver" mirror layer dyed yellow, obtainable by means of metal pigments dyed yellow, which are known from WO 2005/051675 A2 (the metal pigments are based on a metal which is chosen preferably from the group consisting of aluminum, stainless steel, nichrome, gold, silver, platinum and copper; the metal is in particular preferably aluminum, wherein the average particle diameter preferably lies in a range from 8 to further preferably in a range from 9 to 10 as measured with Coulter LS130 laser diffraction granulometer; such a printing ink enables the supplying of a "silver" mirror layer, b) a carrier substrate, c) a blue color layer preferably 1 to 2 micrometer thick, d) a "silver" mirror layer dyed yellow, obtainable by means of metal pigments dyed yellow which are known from WO 2005/051675 A2 (see for this purpose the description as to layer a));

3) the layer systems stated above under 1) and 2) can, of course, be varied with regard to the yellow color layer and the blue color layer to the effect that colors other than blue or yellow are employed which are in particular mutually complementary.

For the sealing of the plastic foil molding with the cover foil, the cover foil can have in particular a heat-seal coating, e.g. a heat-seal binder (herein also called heat-seal lacquer) which is arranged by means of an optionally present adhesion promoter (herein also called heat-seal lacquer primer) on the cover foil. Suitable for medicine-blister packages is e.g. a combination of an adhesion promoter based on PVC and the heat-seal binder commercially obtainable from the company Evonik with the trade name "DEGALAN® P24". Suitable for medicine blister packages is e.g. also the heat-seal binder based on heat-sealable pearl polymers and commercially obtainable from the company Evonik under the trade name "DEGALAN® VP P34" for which no preceding primer having an adhesion promoter is required.

A cover foil usable for the inventive blister package can have e.g. a thickness in the range from 5 micrometers to 100 micrometers, preferably from 5 micrometers to 60 micrometers, further preferably in the range from 10 micrometers to 30 micrometers, in particular preferably in the range from 15 micrometers to 25 micrometers.

The opaque cover foil is in particular a press-through foil for a push-through foil package in which the press-through foil closes up the packaged goods (e.g. pharmaceutical products such as tablets), but can be torn open or broken by pushing the packaging goods through. The capability of the breaking open can additionally be increased by mechanical action, e.g. by means of perforations and/or cutting grooves and/or thinned regions in the cover foil (which are obtainable e.g. by means of embossing). The cover foil is based in particular on one of the following materials: Metal, such as aluminum, in particular hard aluminum, soft aluminum, paper-aluminum combination or paper-polyester-aluminum laminate; aluminum is preferred.

Further embodiment examples as well as advantages of the invention will be explained hereinafter with reference to the schematically very simplified figures, in whose representation a rendition that is true to scale and to proportion has been dispensed with in order to increase the clearness.

BRIEF DESCRIPTION OF THE DRAWINGS

There are shown:

FIGS. 1 to 7 illustrate the mode of function of an inventive blister package according to a first embodiment example. The blister package is described in the present example with the help of a tablet blister.

DETAILED DESCRIPTION OF VARIOUS EMBODIMENTS

Figure 1:
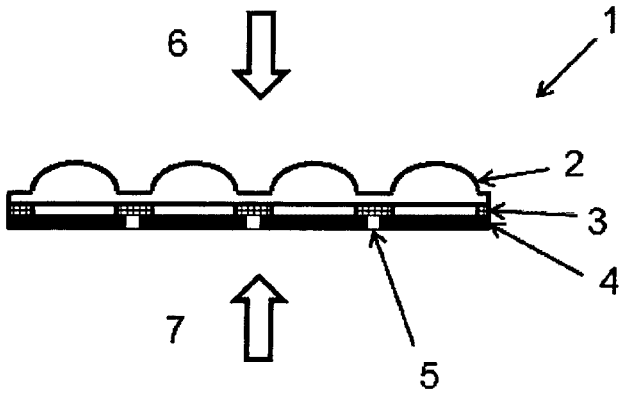
FIGS. 1 to 7 an inventive blister package according to a first embodiment example.

FIG. 1 shows the cross-sectional view of a tablet blister 1 which comprises a transparent plastic foil molding 2 and an opaque cover foil 4. The block arrow 6 symbolizes the viewing of the tablet blister 1 from the front side, the block arrow 7 symbolizes the viewing of the tablet blister 1 from the back side. The opaque cover foil 4 is based on an aluminum foil furnished with a heat-seal coating with a thickness of 20 micrometers. The opaque cover foil 4 has transparent regions 5, namely recesses generated by means of punching or by means of laser cutting. Between the opaque cover foil 4 and the plastic foil molding 2, a carrier substrate furnished with a semi-transparent function layer 3 is arranged, namely a polyethylene terephthalate (PET) foil. The carrier substrate 3 furnished with a semi-transparent function layer is fastened by means of an adhesive layer with the plastic foil molding 2. The plastic foil molding 2 has cavities in which tablets are located (not shown in the figure).

The semi-transparent function is based on the layer sequence 20 nm Ag/240 nm $SiO_2$/20 nm Ag and shows a gold/blue color change in incident light/transmitted light viewing. The semi-transparent function layer is obtainable by means of vapor deposition.

Figure 2:
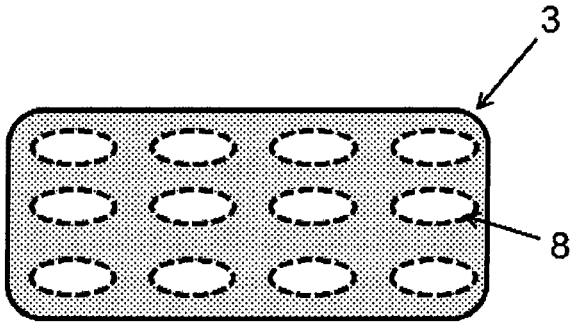

FIG. 2 shows the shape of the carrier substrate furnished with the semi-transparent function layer 3 in plan view. The carrier substrate 3 is left blank in the regions 8 which correspond to the contour lines of the cavities of the plastic foil molding 2.

Figure 3:
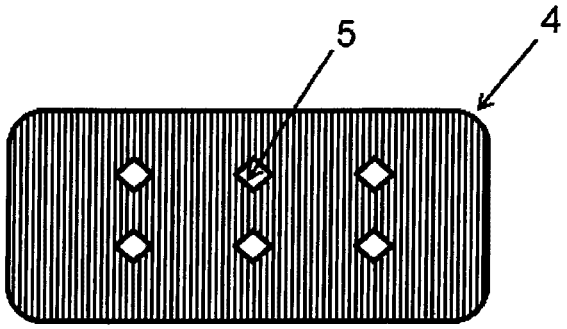

FIG. 3 shows the shape of the opaque cover foil 4 in plan view. The opaque cover foil 4 is left blank in the regions 5.

Figure 4:
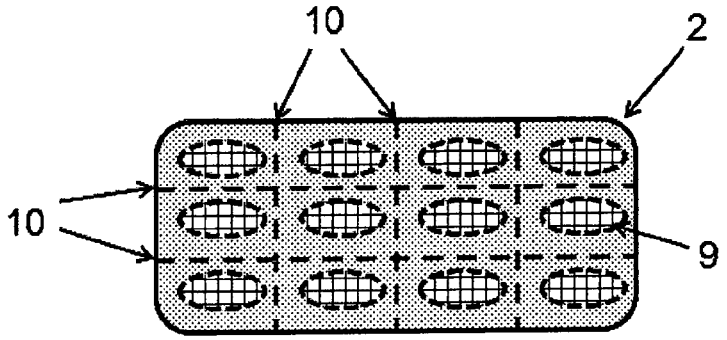

FIG. 4 shows the front side of the tablet blister 1, namely the plastic foil molding 2, upon viewing in incident light. Optionally present perforations are represented with the reference number 10. The viewer perceives the tabloids 9 through the transparent plastic foil molding 2. As a background to the tablets 9, the viewer recognizes the carrier substrate furnished with the semi-transparent function layer 3 in the form of a homogeneous, gold-colored metallization.

Figure 5:
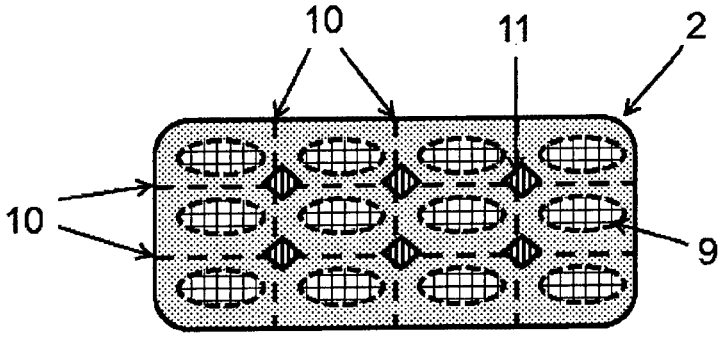

FIG. 5 shows the front side of the tablet blister 1, namely the plastic foil molding 2, upon viewing in transmitted light. The viewer perceives the tabloids 9 through the transparent plastic foil molding 2. As a background to the tablets 9, the viewer recognizes the carrier substrate furnished with the semi-transparent function layer 3 in the form of a homogeneous, gold-colored metallization, wherein the additional regions 11 represented by hatching are visible in light blue.

Figure 6:
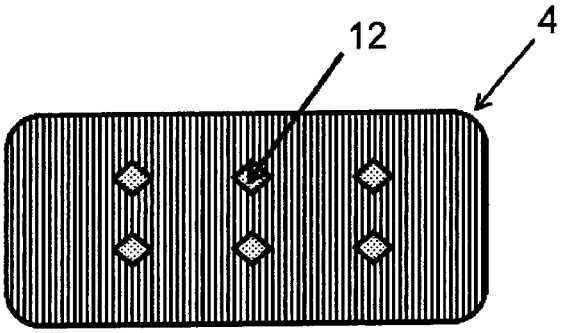

FIG. 6 shows the back side of the tablet blister 1, namely the opaque cover foil 4 based on aluminum, upon viewing in incident light. The opaque cover foil 4 has the shape of a homogeneous, silver metallization, wherein in the regions of the recesses 12 the carrier substrate furnished with the semi-transparent function layer 3 is visible in the shape of a gold-colored metallization.

Figure 7:
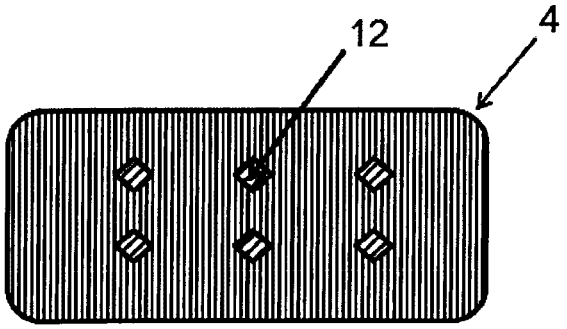

FIG. 7 shows the back side of the tablet blister 1, namely the opaque cover foil 4 based aluminum, upon viewing in transmitted light. The opaque cover foil 4 has the figure of a homogeneous, silver metallization, wherein in the regions of the recesses 12 the carrier substrate furnished with the semi-transparent function layer 3 is visible in light blue.

FIGS. 8 to 14 illustrate the mode of function of an inventive blister package according to the second embodiment example. The blister package is described in the present example with the help of a tablet blister.

Figure 8:
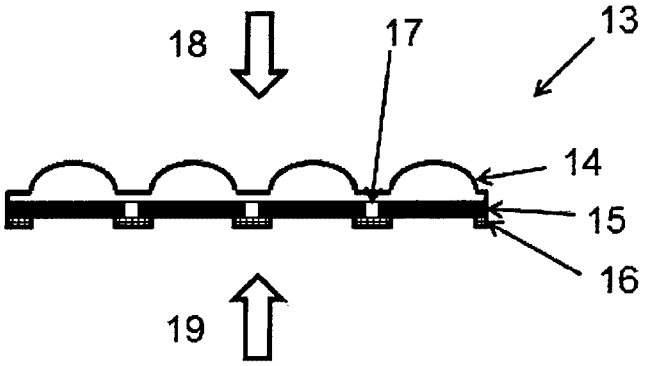
FIGS. 8 to 14 an inventive blister package according to a second embodiment example.

FIG. 8 shows the cross-sectional view of a tablet blister 13 which comprises a transparent plastic foil molding 14 and an opaque cover foil 15. The block arrow 18 symbolizes the viewing of the tablet blister 13 from the front side, the block arrow 19 symbolizes the viewing of the tablet blister 13 from the back side. The opaque cover foil 15 is based on an aluminum foil furnished with a heat-seal coating with a thickness of 20 micrometers. The opaque cover foil 15 has transparent regions 17, namely recesses generated by means of punching or by means of laser cutting. Above the opaque cover foil 15, on the side of the cover foil 15 distant to the plastic foil molding 14, a carrier substrate furnished with a semi-transparent function layer 16, namely a polyethylene terephthalate (PET) foil, is arranged. The carrier substrate 16 furnished with a semi-transparent function layer is fastened by means of an adhesive layer with the opaque cover foil 15. The plastic foil molding 14 has cavities in which tablets are located (not shown in the figure).

The semi-transparent function is based on the layer sequence 20 nm Ag/240 nm $SiO_2$/20 nm Ag and shows a gold/blue color change in incident light/transmitted light viewing. The semi-transparent function layer is obtainable by means of vapor deposition.

Figure 9:
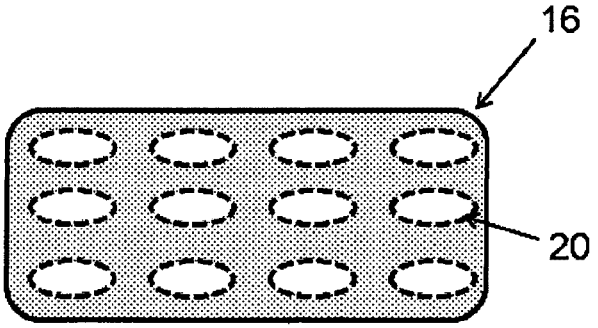

FIG. 9 shows the shape of the carrier substrate furnished with the semi-transparent function layer 16 in plan view. The carrier substrate 16 is left blank in the regions 20 which correspond to the contour lines of the cavities of the plastic foil molding 14.

Figure 10:
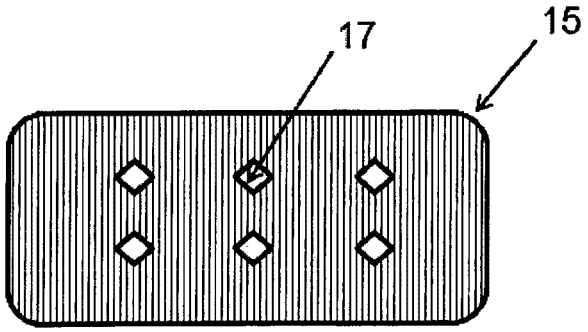

FIG. 10 shows the shape of the opaque cover foil 15 in plan view. The opaque cover foil 15 is left blank in the regions 17.

Figure 11:
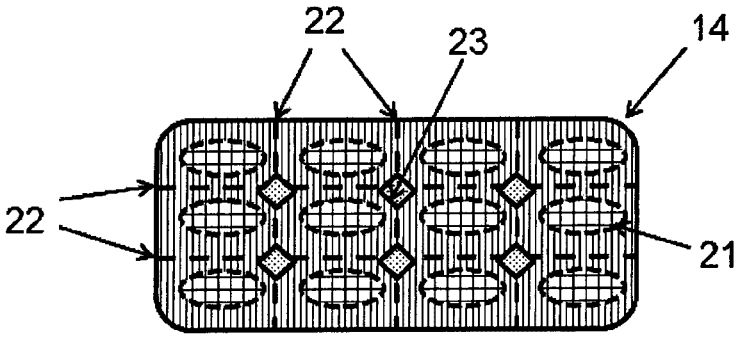

FIG. 11 shows the front side of the tablet blister 13, namely the plastic foil molding 14, upon viewing in incident light. Optionally present perforations are represented with the reference number 22. The viewer perceives the tabloids 21 through the transparent plastic foil molding 14. As a background to the tablets 21, the viewer recognizes the opaque cover foil 15 in the shape of a silver metallization, wherein in the regions of the recesses 23 the carrier substrate 16, which is arranged below the opaque cover foil 15 and furnished with the semi-transparent function layer, is visible in the shape of a gold-colored metallization.

Figure 12:
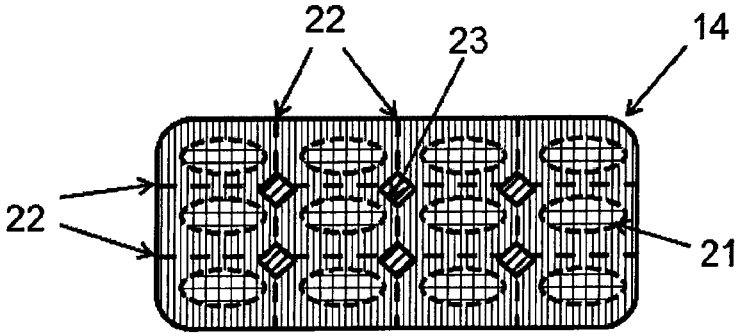

FIG. 12 shows the front side of the tablet blister 13, namely the plastic foil molding 14, upon viewing in transmitted light. The viewer perceives the tabloids 21 through the transparent plastic foil molding 14. As a background to the tablets 21, the viewer recognizes the opaque cover foil 15 in the shape of a silver metallization, wherein in the regions of the recesses 23 the carrier substrate 16, which is arranged below the opaque cover foil 15 and furnished with the semi-transparent function layer, is visible is light blue.

Figure 13:
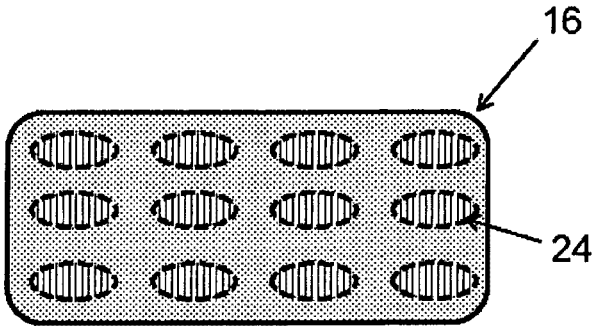

FIG. 13 shows the back side of the tablet blister 13, namely the carrier substrate furnished with the semi-transparent function layer 16, upon viewing in incident light. The carrier substrate 16 furnished with the semi-transparent function layer has the shape of a gold-colored metallization, wherein in the regions of the recesses 24, the opaque cover foil 15 is visible in the shape of a silver metallization.

Figure 14:
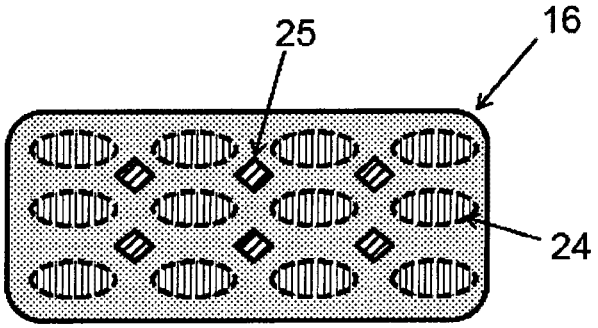

FIG. 14 shows the back side of the tablet blister 13, namely the carrier substrate furnished with the semi-transparent function layer 16, upon viewing in transmitted light. The carrier substrate furnished with the semi-transparent function layer 16 has the figure of a gold-colored metallization and the regions 25 appear in light blue. In the regions of the recesses 24, the opaque cover foil 15 is visible in the shape of a silver metallization.

Figure 15:
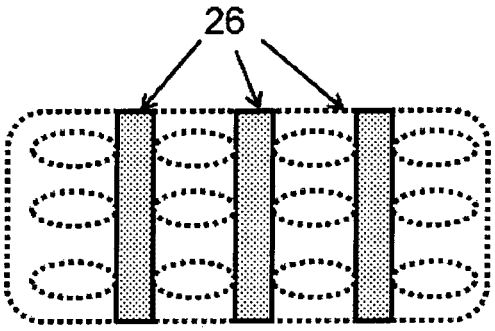
FIG. 15 an alternative embodiment of the semi-transparent function layers represented in FIG. 2 or in FIG. 9.

A third embodiment example is based on the first embodiment example described in the FIGS. 1 to 7. The shape of the carrier substrate 3, shown in FIG. 2, furnished with the semi-transparent function layer is, however, modified to the effect that the carrier substrate furnished with the semi-transparent function layer is present not as an individual object, but in the form of a multiplicity, namely in form of the strips 26 shown in the FIG. 15.

A fourth embodiment example is based on the second embodiment example described in the FIGS. 8 to 14. The shape of the carrier substrate 16, shown in FIG. 9, furnished with the semi-transparent function layer is, however, modified to the effect that the carrier substrate furnished with the semi-transparent function layer is present not as an individual object, but in the form of a multiplicity, namely in form of the strips 26 shown in the FIG. 15.

Figure 16:
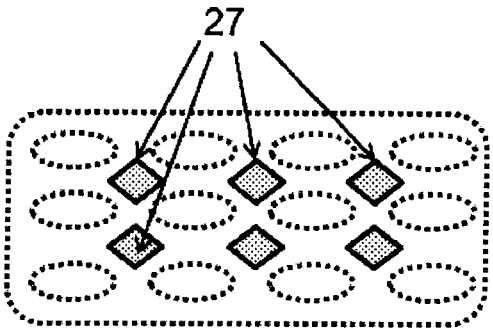
FIG. 16 an further alternative embodiment of the semi-transparent function layers represented in FIG. 2 or in FIG. 9.

A fifth embodiment example is based on the first embodiment example described in the FIGS. 1 to 7. The shape of the carrier substrate 3, shown in FIG. 2, furnished with the semi-transparent function layer is, however, modified to the effect that the carrier substrate furnished with the semi-transparent function layer is present not as an individual object, but in the form of a multiplicity, namely in form of the patches 27 shown in the FIG. 16.

A sixth embodiment example is based on the second embodiment example described in the FIGS. 8 to 14. The shape of the carrier substrate 16, shown in FIG. 9, furnished with the semi-transparent function layer is, however, modified to the effect that the carrier substrate furnished with the semi-transparent function layer is present not as an individual object, but in the form of a multiplicity, namely in form of the patches 27 shown in the FIG. 16.

The invention claimed is:

1. A blister package comprising:

a plastic foil molding furnished with cavities; and an opaque cover foil having at least one transparent region arranged outside of the cavities, wherein the plastic foil molding defines the front side of the blister package and the opaque cover foil defines the back side of the blister package, and wherein the blister package further comprises a semi-transparent function layer in a certain region, which is formed outside of the region of the cavities of the plastic foil molding and is arranged overlapping at least the transparent region of the opaque cover foil, and wherein the semi-transparent function layer is constituted such that the blister package has in the transparent region of the opaque cover foil, upon viewing in incident light a first, visually recognizable color and upon viewing in transmitted light, a second, visually recognizable color.

2. The blister package according to claim 1, wherein the semi-transparent function layer is formed on a carrier substrate and the carrier substrate furnished with the semi-transparent function layer is arranged between the plastic foil molding and the opaque cover foil.

3. The blister package according to claim 1, wherein the semi-transparent function layer is formed on a carrier substrate, and the opaque cover foil is arranged between the plastic foil molding and the carrier substrate furnished with the semi-transparent function layer.

4. The blister package according to claim 1, wherein the semi-transparent function layer is formed either directly on the plastic foil molding or within the plastic foil molding.

5. The blister package according to claim 1, wherein the semi-transparent function layer has a multilayer construction having two semi-transparent metallic layers and a dielectric layer arranged between the two semi-transparent metallic layers.

6. The blister package according to claim 5, wherein the two semi-transparent metallic layers are formed independently of each other from a metal and the metal respectively is chosen from the group consisting of Al, Ag, Ni, Cr, Cu, Au and an alloy of one or several of the hereinabove mentioned elements and the dielectric layer is a SiO2 layer, a ZnO layer, an Al2O3 layer, a TiO2 layer, a layer of a nitride or oxynitride of the elements Si, Zn, Al or Ti or a MgF2 layer or a nitrocellulose layer, obtainable by printing technology.

7. The blister package according to claim 6, wherein the two semi-transparent metallic layers are chosen from Al or Ag and the dielectric layer is a Si02 layer.

8. The blister package according to claim 5, wherein the blister package in the transparent region of the opaque cover foil upon viewing in incident light appears gold-colored and upon viewing in transmitted light has a blue color tone.

9. The blister package according to claim 1, wherein the semi-transparent function layer is obtainable by printing technology by means of an effect pigment composition.

10. The blister package according to claim 1, wherein the opaque cover foil is a metallic foil and the transparent region of the opaque cover foil is formed in the form of a recess in the opaque cover foil.

11. The blister package according to claim 1, wherein the blister package is a blister for pharmaceutical products.

12. A method for manufacturing a blister package, the method comprising:

providing a plastic foil molding furnished with cavities;

providing an opaque cover foil having at least one transparent region; a covering the plastic foil molding furnished with the cavities with the cover foil such that the at least one transparent region is arranged outside of the cavities, the plastic foil molding defines the front side of the blister package and the opaque cover foil defines the back side of the blister package; and providing a semi-transparent function layer to the blister package in a certain region, which is formed outside of the region of the cavities of the plastic foil molding and is arranged overlapping at least the transparent region of the opaque cover foil, wherein the semi-transparent function layer is constituted such that the blister package has in the transparent region of the opaque cover foil, upon viewing in incident light, a first, visually recognizable color and upon viewing in transmitted light, a second, visually recognizable color.

* * * * *